United States Patent [19]

Sugimoto et al.

[11] Patent Number: 4,743,416

[45] Date of Patent: May 10, 1988

[54] MELT SPINNING PROCESS OF AROMATIC POLYESTER

[75] Inventors: Hiroaki Sugimoto, Takatsuki; Toshiyuki Kobashi; Seiji Takao, both of Okayama, all of Japan

[73] Assignees: Sumitomo Chemical Company, Limited; Japan Exlan Company, Ltd., both of Osaka, Japan

[21] Appl. No.: 804,823

[22] Filed: Dec. 5, 1985

[30] Foreign Application Priority Data

| | | | |
|---|---|---|---|
| Dec. 10, 1984 | [JP] | Japan | 59-261573 |
| Dec. 11, 1984 | [JP] | Japan | 59-261236 |
| Dec. 11, 1984 | [JP] | Japan | 59-261237 |

[51] Int. Cl.[4] ..... D01D 5/08

[52] U.S. Cl. ..... 264/40.3; 264/176.1; 264/211.22; 528/190

[58] Field of Search ..... 264/176 F, 211.21, 211.22, 264/211.14, 40.3, 176.1; 528/190

[56] References Cited

U.S. PATENT DOCUMENTS

| | | | |
|---|---|---|---|
| 3,846,377 | 11/1974 | Siegmann | 264/176 F |
| 3,969,462 | 7/1976 | Stofan | 264/176 F |
| 4,118,372 | 10/1978 | Schaefgen | 528/190 |

FOREIGN PATENT DOCUMENTS

| | | |
|---|---|---|
| 1080393 | 6/1980 | Canada . |
| 1507207 | 4/1978 | United Kingdom . |
| 1508646 | 4/1978 | United Kingdom . |

*Primary Examiner*—Jan H. Silbaugh
*Assistant Examiner*—Hubert C. Lorin
*Attorney, Agent, or Firm*—Stevens, Davis, Miller & Mosher

[57] ABSTRACT

An aromatic polyester showing anisotropy in the molten state is melt spun stably for a long period of time by controlling an extrusion pressure at a nozzle portion to 3 kg/cm$^2$G or higher and an atmospheric temperature $T_N$ at a nozzle outlet to a degree satisfying the following formula: $(T_F-100) \leqq T_N \leqq T_F$, wherein $T_F$ is a flowing temperature of the aromatic polyester, and preferably controlling the pressure of a polymer melt at a tip outlet of an extruder to 15 kg/cm$^2$G or higher, whereby a highly orientated fiber of fine denier is obtained.

5 Claims, No Drawings

MELT SPINNING PROCESS OF AROMATIC POLYESTER

BACKGROUND OF THE INVENTION

The present invention relates to a melt spinning process stably practicable for a long period of time.

More specifically, the invention relates to a process for melt spinning aromatic polyesters to produce aromatic polyester fibers having high strength and high modulus of elasticity, which process is stably practicable for a long period of time.

Recently, aromatic polyesters showing anisotropy in the molten state have been found to give polyester fibers having high strength and high modulus of elasticity. And the melt spinning process has many advantages in that no solvent is used and existing apparatus can be employed. However, the aromatic polyesters capable of giving polyester fibers having high strength and high modulus of elasticity requires a high processing (spinning) temperature for the spinning, and therefore at the time of spinning, occurrence of increasing of viscosity and foaming due to the reactions such as decomposition, polymerization, crosslinking and the like cannot be avoided, and the viscosity of the melt extruded readily varies due to a remarkable temperature dependence. These make it difficult to continue the spinning stably for a long period of time.

While physical properties of the fiber can be improved, as known, by making the fiber fine (fine denier), it is difficult to spin the aromatic polyesters showing anisotropy in the molten state in a fine denier because of the cooling solidification rate thereof being extremely high. For example, minimizing of the hole diameter of the nozzle causes various problems such that a nozzle processing is made difficult and plugging of the nozzle readily occurs.

So far, different kinds of aromatic polyesters showing anisotropy in the molten state have been proposed, for example, in Published Examined Japanese Patent Application No. 482/1980, and the like. However, the embodiments disclosed therein are only on a laboratory scale and therefore not useful from industrial point of view. Thus, it has been desired to develop a melt spinning process industrially stably practicable for a long period of time.

SUMMARY OF THE INVENTION

It is an object of the present invention to provide a process for melt spinning an aromatic polyester stably for a long period of time, the aromatic polyester showing anisotropy in the molten state and inherently having problems such as difficult deaeration, generation of decomposition gases and so on, unlike polyesters showing no anisotropy.

It is another object of the present invention to provide a process for melt spinning such aromatic polyester stably for a long period of time to produce a highly orientated fiber of a fine denier.

The present invention provides a process for producing an orientated fiber of a fine denier stably for a long period of time by melt spinning an aromatic polyester showing anisotropy in the molten state, characterized in that the melt spinning is carried out while controlling an extrusion pressure at a nozzle portion to 3 kg/cm$^2$G or higher, and an atmospheric temperature $T_N$ at a nozzle outlet to a degree satisfying the following formula:

$$(T_F-100) \leqq T_N \leqq T_F$$

wherein $T_F$ is a flowing temperature of the aromatic polyester, and preferably controlling the pressure of a polymer melt at a tip outlet of an extruder to 15 kg/cm$^2$G or higher.

DESCRIPTION OF THE PREFERRED EMBODIMENTS

In the process of the present invention, an aromatic polyester showing anisotropy in the molten state is used.

The aromatic polyester to be used is the one capable of transmitting light at a temperature, at which the aromatic polyester becomes flowable, when the powdery polyester sample is put and heated on a heating sample stage placed between two polarizing plates which are at right angles (90°) from each other. Examples of the aromatic polyester are those prepared from aromatic dicarboxylic acids, aromatic diols and/or aromatic hydroxycarboxylic acids, and their derivatives, as disclosed in Published Examined Japanese Patent Application Nos. 18016/1981, 20008/1980 and the like. If desired, aromatic polyesters may be copolymers prepared from the aforesaid compounds with alicyclic dicarboxylic acids, alicyclic diols, aliphatic diols and their derivatives.

Examples of the aromatic dicarboxylic acids are terephthalic acid, isophthalic acid, 4,4'-dicarboxydiphenyl, 2,6-dicarboxynaphthalene, 1,2-bis(4-carboxyphenoxy)ethane and their derivatives substituted on the nucleus with alkyl, aryl, alkoxy or halogen.

Examples of the aromatic diols are hydroquinone, resorcinol, 4,4'-dihydroxydiphenyl, 4,4'-dihydroxybenzophenone, 4,4'-dihydroxydiphenylmethane, 4,4'-dihydroxydiphenylethane, 2,2-bis(4-hydroxyphenyl)propane, 4,4'-dihydroxydiphenylether, 4,4'-dihydroxydiphenylsulfone, 4,4'-dihydroxydiphenylsulfide, 2,6-dihydroxynaphthalene, 1,5-dihydroxynaphthalene and their derivatives substituted on the nucleus with alkyl, aryl, alkoxy or halogen.

Examples of the aromatic hydroxycarboxylic acids are p-hydroxybenzoic acid, m-hydroxybenzoic acid, 2-hydroxynaphthalene-6-carboxylic acid, 1-hydroxynaphthalene-5-carboxylic acid and their derivatives substituted on the nucleus with alkyl, aryl, alkoxy or halogen.

Examples of the alicyclic dicarboxylic acids are trans-1,4-dicarboxycyclohexane, cis-1,4-dicarboxycyclohexane and their derivatives substituted on the nucleus with alkyl, aryl or halogen.

Examples of the alicyclic and aliphatic diols are trans-1,4-dihydroxycyclohexane, cis-1,4-dihydroxycyclophexane, ethylene glycol, 1,4-butanediol, xylylenediol and the like.

Of these aromatic polyesters prepared using a combination of the acid compounds and the hydroxyl compounds as described above, preferred are:

(i) a copolyester comprising p-hydroxybenzoic acid residue (40 to 70 mole %), the aromatic dicarboxylic acid residue (15 to 30 mole %) and the aromatic diol residue (15 to 30 mole %), (ii) a copolyester prepared by the reaction of terephthalic acid and/or isophthalic acid with chlorohydroquinone, phenylhydroquinone and/or hydroquinone, (iii) a copolyester comprising p-hydroxybenzoic acid residue (20 to 80 mole %) and 2-hydroxynaphthalene-6-carboxylic acid residue (20 to 80 mole %), and so on.

In the preparation of the aromatic polyester usable for the process of the present invention using the aforesaid starting materials, said materials as such or after esterification with an aliphatic or aromatic monocarboxylic acid or its derivative, or an aliphatic alcohol, a phenol or its derivative, can be subjected to polycondensation reaction according to, for example, a bulk polymerization, solution polymerization or suspension polymerization method known in this art. The reaction can be carried out at a temperature ranging from 150° to 360° C. under atmospheric pressure or a reduced pressure ranging from 10 to 0.1 torr, if desired, in the presence of a polymerization catalyst such as Sb-, Ti- or Ge-containing compounds, a stabilizer such as phosphorus compounds and/or a filler such as $TiO_2$, $CaCO_3$, talc and the like. The resulting polyester as such or after pulverization is heat-treated in an inert gas atmosphere or under a reduced pressure prior to the spinning. The polyester may be formed into a granule through an extruder prior to the heat-treatment.

The aromatic polyester usable in the present invention may be defined in terms of the molecular weight. However, there are problems such that depending on the composition and structure of the polymer, a solvent capable of dissolving the polymer uniformly can hardly be found, and accuracy in the measurement of molecular weight is questionable. Accordingly, the molecular weight cannot be used for the definition of the aromatic polyester usable in the present invention. For this reason, a "flowing temperature" is used therefor, which is a physical value corresponding to the molecular weight. In the present invention, the flowing temperature is defined to be a temperature, at which the aromatic polyester flows through a nozzle of 1 mm in diameter and 10 mm in length, and reaches an apparent viscosity of 48,000 poise, when heated at a rate of 4° C./min. under a pressure of 100 kg/cm$^2$ using Flow Tester CFT-500, manufactured by Shimadzu Corp. in Japan.

In the present invention, it has been found that an aromatic polyester having a flowing temperature ranging from 280° to 380° C. is useful for the spinning to produce desired polyester fibers having high strength and high modulus of elasticity. In case of using an aromatic polyester having a flowing temperature lower than that defined above, reactions readily occur in the molten state, and elongation percentage of the fiber becomes insufficient. Whereas, in case of using an aromatic polyester having a flowing temperature higher than that defined above, the decomposition and cross-linking reactions readily occur, and a load on the apparatus becomes large, because such polyester requires a higher processing (spinning) temperature.

The melt spinning process of the present invention can be carried out using any apparatus, provided that it is equipped with a melting means such as plunger, screw, melt grid and the like equipped with a heat controlling means, a measuring means such as gear pump, and a spinning head (nozzle) including a spinneret, but using a screw type extruder is preferable because of continuous spinnability.

The temperature suitable for the melt spinning in the present invention ranges from 280° to 420° C., preferably from 300° to 400° C., for the reason described above.

As a spinning nozzle, any conventional ones can be used. Preferred is the one having a hole size of 0.15 mm or less and 0.8 or more in a ratio (1/d) of a hole length (1) and the hole diameter (d). A first important point in the melt spinning of the present invention is to control the extrusion pressure at the nozzle portion to 3 kg/cm$^2$G or higher, wherein G means a gauge pressure.

The extrusion pressure at the nozzle portion is defined as the pressure exerted on the polymer melt at the nozzle, when the polymer melt flows through the nozzle (orifices) and is extruded to the atmosphere in the form of fiber.

An apparent melt viscosiry at the spinning of the aromatic polyester showing anisotropy appears to be from 10 to 10,000 poise, which is lower than that of a conventional melt-spinnable polymer. This is probably because of a cohesion state of the molecules at the time of melting. Only for this reason, it would be expected that the spinning may be carried out under a lower extrusion pressure at the nozzle portion. On the contrary, interesting is finding that when the melt spinning is carried out under an extrusion pressure at the nozzle portion of less than 3 kg/cm$^2$G, occurrence of borken filament or herical extrusion like melt-fracture makes a stable spinning impossible. Thus, the spinning under an extrusion pressure at the nozzle portion of 3 kg/cm$^2$G or higher can result in a stable spinning to produce a high quality fiber.

The extrusion pressure at the nozzle portion can be controlled to 3 kg/cm$^2$G or higher by coordinating a shape of the nozzle, a spinning temperature of the melt, an extrusion rate and the like.

In the present invention, a second important point is to control a temperature of atmosphere from extrusion of the melt through the nozzle to cooling solidification thereof, i.e. an atmospheric temperature at the nozzle outlet. In case of the aromatic polyester showing anisotropy in the molten state, the distance to the cooling solidification is very short, unlike in a conventional melt spinnable polymer. This is probably because the polymer molecule is orientated to a considerable degree so that the crystallization is facilitated. For this reason, it is important to control the atmospheric temperature at the nozzle outlet from the viewpoint of a stable spinning and a high quality fiber. The atmospheric temperature at the nozzle outlet $T_N$ is controlled to satisfy the following formula: $(T_F\text{-}100) \leqq T_N \leqq T_F$, wherein $T_F$ is a flowing temperature of the aromatic polyester.

More exactly speaking, the atmospheric temperature at the nozzle outlet is a temperature at a portion of 5 mm below from the nozzle surface. The temperatures of the nozzle center and the nozzle edge are preferably not different. When the atmospheric temperature at the nozzle outlet is higher than the flowing temperature of the aromatic polyester, deterioration in the physical properties of the fiber and break of the filaments at the time of spinning occur, probably because of problems such as relaxation of the orientation.

The atmospheric temperature at the nozzle outlet can be controlled, for example, in a manner such that a cylindrical spinning cylinder is connected to the nozzle portion, and heated by means of a barrel heater, infrared heater, heat medium or the like.

In the case of a melt spinning method without using an extruder, for example, a melt grid method, the stable melt spinning can be achieved by controlling the extrusion pressure at the nozzle portion and the atmospheric temperature at the nozzle outlet in the ranges mentioned above.

A third important point in the present invention is to control the pressure of the molten aromatic polyester at a tip outlet of the extruder to 15 kg/cm$^2$G or higher, in which G means a gauge pressure, said tip outlet connecting to the nozzle. The pressure of the melt at the tip outlet of the extruder of lower than 15 kg/cm$^2$G causes problems from the viewpoint of a stable spinning and a quality of the fiber, because break of the filaments occurs at the time of spinning and bubbles become contained in the fiber obtained. While an upper limit of the pressure is not particularly limited, a preferred upper limit is 300 kg/cm$^2$G from the viewpoint of the apparatus maintenance.

In order to facilitate a thorough mixing of the melt and to control the pressure of the melt at the tip outlet of the extruder to 15 kg/cm$^2$G or higher, the tip outlet of the extruder is preferably equipped with a wire net filter, candle filter, leaf disk filter and the like. The tip outlet passage of the extruder may be narrowed to produce a fluid resistance. Alternatively, the pressure of the melt at the tip outlet of the extruder may be controlled also in a manner such that a measuring gear pump is provided to the tip outlet of the extruder, and the sending rate of the gear pump and the extruding rate of the extruder are controlled.

As one embodiment of carrying out the melt spinning using both the extruder such as a screw-type extruder and the nozzle, the pressure on the polymer melt at the tip outlet of extruder is controlled to 15 kg/cm$^2$G or higher and then the pressure on the polymer melt may be reduced to below 15 kg/cm$^2$G before supplied to the spinning head (nozzle) including a spinneret.

The fibers produced by the spinning in accordance with the present invention can be wound up or drawn as they are or after addition of an oiling agent. A rate of windup or drawdown ranges from 10 to 10,000 m/min, preferably 100 to 2,000 m/min from the viewpoint of the productivity and spinnability. The fineness and sectional shape of the fiber may vary depending on the use. The fineness of 1 to 10 deniers is preferred from the viewpoint of the strength and modulus of elasticity. The thus obtained fiber can be used as it is, or subjected to heat-treatment, drawing or a combination thereof, thereby enhancing the strength and modulus of elasticity much more.

The present invention is illustrated in more detail with reference to the following Examples, Reference Examples and Comparative Examples.

In these Examples, the tensile test of the fiber was conducted using an all-purpose tester No. 1130, manufactured by Instron Co. under a sample distance of 20 mm and a tensile speed of 0.5 mm/min. The distribution of denier was calculated by dividing the standard deviation by the average value. The optical anisotropy was visually judged on the sample placed on a heating stage and heated at a rate of 25° C./min under polarized light.

REFERENCE EXAMPLE 1 p-Acetoxybenzoic acid (7.20 kg, 40 moles), terephthalic acid (2.49 kg, 15 moles), isophthalic acid (0.83 kg, 5 moles) and 4,4'-diacetoxydiphenyl (5.45 kg, 20.2 moles) were placed in a polymerization vessel equipped with a comb-like stirrer. The mixture was heated under a nitrogen gas atmosphere, while being stirred. Polymerization was continued under vigorous stirring at 330° C. for 3 hours, during which acetic acid produced was removed out of the reaction system. Thereafter, the reaction mixture was gradually cooled and at 200° C. taken out of the system to obtain a desired polymer (10.88 kg). The yield was 97.8% of the theoretical value. The polymer obtained was pulverized using a hammer mill to form particles of 2.5 mm or below in the particle size. The polymer in the form of particle was treated in a rotary kiln under a nitrogen gas atmosphere at 280° C. for 5 hours, whereby a polymer having the flowing temperature of 326° C. was obtained. The optical anisotropy was observed at a temperature of 350° C. or higher.

REFERENCE EXAMPLE 2

In a manner similar to that of Reference Example 1, there was obtained a polyester having a monomer unit of p-hydroxybenzoic acid/terephthalic acid/isophthalic acid/4,4'-dihydroxydiphenyl in a molar ratio of 300/60/40/100. The flowing temperature thereof was found to be 330° C., and the optical anisotropy was observed at a temperature of 355° C. or higher.

REFERENCE EXAMPLE 3

In a manner similar to that of Reference Example 1, there was obtained a polyester having a monomer unit of p-hydroxybenzoic acid/terephthalic acid/2,6-dihydroxynaphthalene in a molar ratio of 300/100/100. The flowing temperature thereof was found to be 333° C., and the optical anisotropy was observed at a temperature of 355° C. or higher.

REFERENCE EXAMPLE 4

Using the same apparatus as in Reference Example 1, there was obtained a copolyester of 2,5-diacetoxybiphenyl and terephthalic acid. The flowing temperature thereof was found to be 318° C., and the optical anisotropy was observed at a temperature of 340° C. or higher.

EXAMPLE 1

The polyester obtained in Reference Example 1 was melt spun using a screw type extruder having 30 mm in a diameter. The tip of the extruder was equipped with three 400 mesh plane weave wire nets as a filter. The nozzle used was the one having 0.12 mm in an orifice diameter, 0.8 in a ratio l/d and 150 in an orifice number.

A spinning cylinder was furnished around the nozzle, and heated by means of a heater of 100 mm in length. In order to measure the temperature at the portion of 5 mm below the nozzle surface of the nozzle center, a thermocouple was provided so as to come in contact with nozzle surface, but not so as to block the orifice thereof. In addition, another thermocouple was provided to the nozzle edge in order to measure the temperature at the portion of 5 mm below the nozzle surface. The temperature was measured at said two portions. The heater provided to the spinning cylinder was controlled by the said latter thermocouple. The spinning cylinder was provided intimately to the nozzle holder so as to prevent the blowing of wind at the time of spinning.

The spinning was carried out at 365° C. of the spinning temperature and 310° C. of the atmospheric temperature at the nozzle outlet. The pressure of the melt at the tip outlet of the extruder was 30 kg/cm$^2$ G, the extrusion pressure at the nozzle portion was 4.8 kg/cm$^2$ G, and the atmospheric temperature at the nozzle center was within a range from 311° to 314° C. The spinning was continued very stably for about 3 hours. The fiber obtained was found to be pale yellow and transparent, and to have 3.05 denier in fineness, 9.8 g/d in strength, 1.7% in elongation, and 612 g/d in modulus of elasticity. This fiber was heat-treated for 3 hours in a nitrogen atmosphere of 320° C. thereby obtaining a fiber having 2.98 denier in fineness, 30.2 g/d in strength, 3.0% in elongation, and 1,030 g/d in modulus of elasticity. The distribution of denier was found to be as small as 5.7%.

COMPARATIVE EXAMPLE 1

Melt spinning was carried out in a manner similar to that of Example 1, provided that no spinning cylinder was provided. Break of the filaments was observed, probably because of the difference between the temperatures at the inner and outer portions of the nozzle, and difference in the cooling rate. Thus, a stable spinning couldn't be continued. The distribution of denier was as large as 18.9%.

COMPARATIVE EXAMPLE 2

Melt spinning was carried out in a manner similar to that of Example 1, provided that the atmospheric temperature at the nozzle outlet was controlled to 340° C. Break of the filaments and contamination of the nozzle surface was markedly observed. Moreover, there were observed many bubbles in the fiber. Thus, a stable spinning couldn't be continued.

COMPARATIVE EXAMPLE 3

Example 1 was repeated twice, provided that the extrusion pressure at the nozzle portion was changed to 0.8 and 1.6 kg/cm$^2$G, respectively.

In both cases, break of the filaments was observed. Moreover, helical extrusion probably because of the contamination of the nozzle surface, and the bubbles in the fiber were observed, and therefore a stable spinning couldn't be continued.

COMPARATIVE EXAMPLE 4

Melt spinning was carried out in a manner similar to that of Example 1, provided that a nozzle having 0.15 mm in a diameter, 1 in the ratio of l/d and 500 in an orifice number was used, and the extrusion pressure at the nozzle portion was controlled to 0.7 kg/cm$^2$G, but a stable spinning couldn't be continued. Even when the extrusion quantity was increased to make the extrusion pressure at the nozzle portion 1.5 kg/cm$^2$G, no change in the spinning state was observed.

EXAMPLE 2

Example 1 was repeated, provided that the polyester obtained in Reference Example 2, and a nozzle having 0.10 mm in a diameter, 2 in the ratio of l/d, and 80 in an orifice number were used, and the spinning temperature, the extrusion pressure at the nozzle portion and the atmospheric temperature at the nozzle outlet were controlled to 370° C., 33 kg/cm$^2$G and 305° C., respectively. No break of the filament was observed, and the spinning was continued very stably. The fiber obtained was heattreated for 3 hours in a nitrogen atmosphere of 320° C., thereby obtaining a fiber having 3.12 denier, 29.7 g/d in strength, 2.9% in elongation and 1,080 g/d in modulus of elasticity. The distribution of denier was found to be 7.2%.

COMPARATIVE EXAMPLE 5

Melt spinning was carried out in a manner similar to that of Example 2, provided that a nozzle having 0.1 mm in diameter, 0.8 is the ratio of l/d and 80 in orifice number was used, and the extrusion pressure at the nozzle portion was controlled to 0.7 to 1.5 kg/cm$^2$G. Break of the filaments was markedly observed, and a stable spinning couldn't be continued.

EXAMPLE 3

Example 2 was repeated, provided that the polyester obtained in Reference Example 3 was used, and the spinning temperature, the atmospheric temperature at the nozzle outlet and the extrusion pressure at the nozzle portion were controlled to 370° C., 305° C. and 15 kg/cm$^2$G, respectively. No break of the filament was observed, and the spinning was continued stably. The fiber obtained was heat-treated for 3 hours in a nitrogen atmosphere of 320° C. to obtain a fiber having 4.26 denier, 20.3 g/d in strength, 3.3% in elongation and 637 g/d in modulus of elasticity.

COMPARATIVE EXAMPLE 6

Comparative Example 5 was repeated, provided that the polyester obtained in Reference Example 3 was used, and the extrusion pressure at the nozzle portion was controlled within a range from 0.8 to 1.6 kg/cm$^2$G. A stable spinning couldn't be continued because of broken filaments and a helical extrusion.

EXAMPLE 4

Example 2 was repeated, provided that the polyester obtained in Reference Example 4 was used, and the spinning temperature, the atmospheric temperature at the nozzle outlet and the extrusion pressure at the nozzle portion were controlled to 360° C., 305° C. and 10 kg/cm$^2$G, respectively. No break of the filament was observed, and the spinning was continued stably. The fiber obtained was heat-treated for 3 hours in a nitrogen atmosphere of 320° C. to obtain a fiber having 4.62 denier, 21.8 g/d in strength, 2.7% in elongation and 831 g/d in modulus of elasticity. The distribution of denier was found to be 5.9%.

COMPARATIVE EXAMPLE 7

Melt spinning was carried out in a manner similar to that of Example 4, provided that the polyester obtained in Reference Example 4 was used, and the spinning temperature, the atmospheric temperature at the nozzle outlet and the extrusion pressure at the nozzle portion were controlled to 360° C., 305° C. and 1.2 kg/cm$^2$G, respectively. Remarkable break of the filaments was observed, and a favorable fiber couldn't be obtained.

COMPARATIVE EXAMPLE 8

Example 4 was repeated, provided that the atmospheric temperature at the nozzle outlet was controlled to 70° C. During 1 hour, cutting of the filament was sometimes observed, and therefore the spinning couldn't be continued stably. The distribution of denier was found to be as high as 10.2%.

What is claimed is:

1. A process for stably melt spinning aromatic polyester showing optical anisotropy in the molten state over a long period of time, comprising the steps of:

(a) controlling the pressure of the polyester in a screw-type extruder having a tip outlet to obtain a tip outlet pressure of at least 15 $Kg/cm^2$ G;

(b) melt spinning the polyester through a nozzle outlet having a hole size of 0.15 mm or less and a ratio (l/d) of the whole length (l) to the whole diameter (d) of said nozzle being 0.8 or more, said nozzle being connected to said tip outlet;

(c) controlling the extrusion pressure at the nozzle portion to obtain at least 3 $Kg/cm^2$ G and an atmospheric temperature $T_N$ at the nozzle outlet to a degree satisfying the following formula:

$$T_F \cdot (100) \leqq T_N \leqq T_F$$

wherein $T_F$ is the flowing temperature of the aromatic polyester.

2. A process according to claim 1, wherein the flowing temperature of the aromatic polyester showing optical anisotropy in the molten state is from 280° C. to 380° C.

3. A process according to claim 1, wherein the tip outlet of extruder is equipped with a wire net filter, a candle filter or a leaf disk filter.

4. A process according to claim 1, wherein the pressure of the polymer melt is controlled by narrowing an outlet passage of the extruder.

5. A process according to claim 1, wherein the pressure of the polymer melt is controlled by providing a measuring gear pump to the tip outlet of the extruder.

* * * * *